US005102755A

United States Patent [19]

Ruhland et al.

[11] Patent Number: 5,102,755

[45] **Date of Patent: * Apr. 7, 1992**

[54] MAGNETIC IMAGE CHARACTER RECOGNITION PROCESSES

[75] Inventors: John G. Ruhland, Rochester; Bernard Grushkin, Pittsford, both of N.Y.

[73] Assignee: Xerox Corporation, Stamford, Conn.

[ * ] Notice: The portion of the term of this patent subsequent to Aug. 22, 2006 has been disclaimed.

[21] Appl. No.: 648,946

[22] Filed: Feb. 1, 1991

[51] Int. Cl.[5] ..... G03G 9/113

[52] U.S. Cl. ..... 430/39; 430/106.6; 430/108; 430/110

[58] Field of Search ..... 430/903, 39, 106.6, 430/108, 110

[56] References Cited

U.S. PATENT DOCUMENTS

| | | | |
|---|---|---|---|
| 3,635,704 | 1/1972 | Palermiti et al. | 96/1 |
| 3,983,045 | 9/1976 | Jugle et al. | 252/62.1 P |
| 4,031,021 | 6/1977 | Deming | 252/62.1 P |
| 4,513,074 | 4/1985 | Nash et al. | 430/106.6 |
| 4,517,268 | 5/1985 | Gruber et al. | 430/39 |
| 4,556,624 | 12/1985 | Gruber et al. | 430/110 |
| 4,557,991 | 12/1985 | Takagiwa et al. | 430/109 |
| 4,681,829 | 7/1987 | Grushkin | 430/109 |
| 4,758,493 | 7/1988 | Young et al. | 430/122 |
| 4,803,143 | 2/1989 | Ostertag et al. | 430/106.6 |
| 4,859,550 | 8/1989 | Gruber et al. | 430/39 |
| 4,883,736 | 11/1989 | Hoffend et al. | 430/110 |
| 4,946,755 | 8/1990 | Inoue | 430/106.6 |

FOREIGN PATENT DOCUMENTS 1442835 10/1972 United Kingdom .

OTHER PUBLICATIONS

Petrolite Corporation brochure on "Unilin TM Alcohols".

*Primary Examiner*—Marion E. McCamish
*Assistant Examiner*—Rosemary Ashton
*Attorney, Agent, or Firm*—E. O. Palazzo

[57] ABSTRACT

An ionographic process which comprises the generation of a latent image comprised of characters; developing the image with a toner comprised of resin particles, magnetite particles, and a crystalline high density wax with a weight average molecular weight of from about 1,000 to about 10,000; and subsequently providing the developed image with magnetic ink characters thereon to a reader/sorter device.

26 Claims, No Drawings

MAGNETIC IMAGE CHARACTER RECOGNITION PROCESSES

BACKGROUND OF THE INVENTION

The present invention is generally directed to imaging processes with toner and developer compositions, and more specifically the present invention is directed to processes for maintaining the conductivity of magnetic image character recognition developers by the addition of certain components thereto, such as waxes, and imaging and printing processes thereof. In one embodiment of the present invention there are provided processes for obtaining MICR toners and developers with a conductivity of from about $10^{-7}$ to about $10^{-12}$ $ohm^{-1}$-$cm^{-1}$ measured, for example, at 10 volts in a cell, which toners can be selected for generating documents, such as checks including, for example, dividend checks, turn around documents such as invoice statements like those submitted to customers by American Express and VISA, corporate checks, highway tickets, identification badges, rebate checks, other documents with magnetic codes thereon, and the like, with no toner smearing. More specifically, in one embodiment the process of the present invention is accomplished by adding Polywaxes, such as POLYWAX 2000 TM available from Petrolite Corporation, to a toner comprised of resin particles, and magentite particles, such as Mapico Black, which toners are rendered conductive by the wax, and wherein the toners can be selected, for example, for the Xerox Corporation 4090 TM magnetic character recognition process. Some advantages associated with the imaging processes of the present invention include a toner with stable conductivity characteristics, and wherein image smearing and offsetting of the toner can be avoided, or minimized to read and write heads, including offsetting to the protective foil that may be present on the aforesaid heads in magnetic ink character recognition processes and apparatus inclusive of, for example, the read and write heads present in MICR (magnetic ink character recognition) reader/sorters such as the commercially available IBM 3890 TM, NCR 6780 TM, reader/sorters available from Burroughs Corporation, and the like. Some of the reader/sorter printers contain protective foils thereon, reference for example the IBM 3890 TM, and the problems associated with such protective foils as illustrated herein with respect to read and write heads with no foils are alleviated with the processes of the present invention. Accordingly, with the processes utilizing the toner and developer compositions illustrated the problems of image smearing to, and offsetting from the read and write heads in magnetic ink character recognition apparatuses can be substantially eliminated in embodiments thereof. Moreover, in another embodiment the present invention is directed to improved economical processes for generating documents, such as personal checks, with conductive toners with a Polywax suitable for magnetic image character recognition wherein image smearing and toner offsetting, including offsetting to read and/or write heads including those with protective foils thereon, or unprotected heads as indicated herein is avoided or minimized when such documents are processed in the aforementioned reader/sorters. The toner compositions obtained with the processes of the present invention in an embodiment are comprised of resin particles, pigment particles, including magnetic components such as magnetites, and certain waxes, such as POLYWAX 2000 TM, present in an amount of from about 1 to about 10 weight percent depending on the conductivity desired for example. There are also provided in accordance with the present invention processes for obtaining positively or negatively charged toner compositions comprised of resin particles, pigment particles, Polywaxes, and charge enhancing additives. In addition, the present invention is directed to processes with developer compositions comprised of the aforementioned toners, and carrier particles.

With further respect to the present invention, the process is particularly applicable to the preparation of conductive developers for the generation of documents including personal checks, which have been fused with soft roll fusers. Fuser rolls such as silicon rolls or other conformable fuser rolls, reference for example the soft fuser rolls incorporated into the Xerox Corporation 4040 TM machine, are useful with the processes of the present invention.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner and developer compositions illustrated herein. The developed image that has been created, for example, in the Xerox Corporation 9700 TM MICR printer, reference the aforesaid '268 patent, contains thereon, for example, the characters zero, 1,2,3,4,5,6,7,8, and 9, and up to four symbols (E-13B and CMC-7 font), which characters are magnetically readable by the IBM 3890 TM, or other similar apparatus. One of the problems avoided with the processes of the present invention is to eliminate or reduce the offsetting of the toner as indicated herein to the read and write heads in the apparatus selected for this purpose such as the IBM 3890 TM.

Developer and toner compositions with certain waxes therein are known. For example, there are disclosed in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45.

In a Petrolite, Inc. brochure, dated 1985 there are disclosed polymeric hydroxy waxes, which brochure indicates that the waxes may have utility as toner.

In U.S. Pat. No. 4,517,268, the disclosure of which is totally incorporated herein by reference, there is illustrated a process for generating documents such as personal checks suitable for magnetic image character recognition, which process involves generating documents in high speed electronic laser printing devices. The developer composition disclosed in this patent is comprised of, for example, magnetic particles, such as magnetite, certain styrene resin particles, and the carrier particles as illustrated in the Abstract of the Disclosure. Additive particles may also be included in the developer compositions of this patent.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014 and 4,394,430.

More specifically, illustrated in U.S. Pat. No. 4,859,550, the disclosure of which is totally incorporated herein by reference are magnetic character recognition processes which comprises the generation of a latent image and developing the latent images with a toner composition comprised of resin particles, pigment particles, magnetic particles, such as magnetite, and an additive component comprised of an aliphatic hydrocarbon, or polymeric alcohols of the formula $$CH_3(CH_2)_nCH_2OH$$

wherein n is a number of from about 30 to about 500, and preferably 300. Another embodiment of the aforementioned patent is directed to an electrophotographic process for obtaining images, which comprises the generation of a latent image in an electronic printing device; thereafter developing the characters with a toner composition comprised of resin particles, pigment particles, magnetite particles, and an additive component comprised of an aliphatic hydrocarbon or polymeric alcohols of the formula $$CH_3(CH_2)_nCH_2OH$$

wherein n is a number of from about 30 to about 300, and subsequently processing the documents with magnetic characters thereon in reader/sorters. Also, in a further embodiment of the aforementioned patent there is provided a xerographic process, which comprises forming a latent image on an imaging member; developing the image with a toner composition comprised of resin particles, magnetite particles, and pigment particles; subsequently transferring the image to a suitable substrate; fixing the image thereto; simultaneously, or thereafter applying to the developed image an aliphatic hydrocarbon or a polymeric alcohol of the formula $$CH_3(CH_2)_nCH_2OH$$

wherein n is a number of from about 30 to about 500, and preferably 300; and subsequently processing the documents with magnetic characters thereon in a reader/sorter. The aforementioned developed images, especially personal checks with magnetic characters thereon, can then be utilized in a reader/sorter without offsetting and image smearing as indicated herein.

In a patentability search report there were recited the following U.S. Pat. Nos. 4,513,074, which discloses a conductive magnetic brush developer and wherein there is included in the toner a polyolefin wax to prolong the life of the developer, and note Example 7 wherein the toner includes 7 percent of an olefin; 4,556,624 directed to a magnetic toner containing an olefin wax; 4,557,991 directed to a magnetic toner containing a polyolefin wax; and 4,681,829 and 4,758,493 which disclose the use of polyolefin waxes, about 2 to 7 weight percent in toners. The disclosures of each of the aforementioned patents are totally incorporated herein by reference.

SUMMARY OF THE INVENTION

It is a feature of the present invention to provide conductive magnetic character recognition processes with toner and developer compositions, and particularly processes for generating documents such as personal checks which are subsequently processed in reader/sorters with many of the advantages illustrated herein.

Another feature of the present invention resides in the provision of processes for generating documents, such as personal checks, suitable for magnetic ink character recognition, which processes utilize toner and developer compositions containing Polywaxes.

In another feature of the present invention there are provided processes for generating documents, such as personal checks, suitable for magnetic ink character recognition, which processes utilize conductive developer compositions containing POLYWAX 2000 TM, and wherein toner offsetting and image smearing can be avoided, or minimized.

Moreover, another feature of the present invention relates to MICR processes with developers with a stable conductivity of from about $10^{-8}$ to about $10^{-11}$ ohm-cm.

Also, in another feature of the present invention there are provided processes wherein, for example, image smearing and toner offsetting can be avoided when documents such as checks containing magnetic characters thereon are utilized in commercial sorters, and/or reader/sorters.

Additionally, in yet another feature of the present invention there are provided magnetic ink character recognition processes (MICR), which processes are suitable for the generation of documents with conductive toner and developer compositions containing POLYWAX 2000 TM, and wherein these checks can be utilized in commercial sorters, and/or reader/sorters, such as the IBM 3890 TM, substantially without toner offsetting and image smearing.

These and other features of the present invention can be accomplished by providing processes with conductive developer compositions that are useful for generating documents inclusive of personal checks, which documents can be subsequently processed in reader/sorter devices as illustrated herein. More specifically, the present invention is directed to processes for generating documents, which comprise the formation of images, such as latent images with a printing device, especially devices generating from about 8 to about 135 prints per minute, such as the Xerox Corporation 4090 TM; developing the image with a two component developer composition (toner+conductive carrier) as illustrated herein, which toner compositions contain, for example, resin particles, magnetite particles, and POLYWAX 2000 TM; subsequently transferring the developed image to a suitable substrate; permanently affixing the image thereto, and thereafter processing the documents in reader/sorters wherein image offsetting and image smearing are avoided or substantially reduced, and the developer retains its conductivity for extended time periods of, for example, 500,000 imaging cycles. Some examples of the aforementioned process wherein a toner with no Polywax is selected is illustrated, for example, in U.S. Pat. No. 4,517,268, the disclosure of which is totally incorporated herein. Examples of high speed electronic printing devices disclosed in the aforementioned patent, which devices can also be utilized for the process of the present invention, include the 8700 TM, and 9700 TM MICR printers available from Xerox Corporation. More specifically, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Also, there can be selected for the processes of the present invention other devices including ionographic printers such as the Delphax 4060 TM printers, the Xerox Corporation 4040 TM, which contains a soft fuser roll for fixing purposes, the Xerox Corporation 4045 TM, 4090 TM and 4050 TM. Thereafter, the formed documents with magnetic characters thereon are processed in reader/-sorter apparatuses as illustrated herein.

The process in an embodiment comprises utilizing a toner comprised of resin particles and pigment particles and a Polywax combined with carrier, which developer can possess a stable conductivity of from about $10^{-7}$ to about $10^{-11}$ ohm-cm. In another embodiment, the process of the present invention comprises adding from about 2 to about 6 weight percent of POLYWAX 2000 TM to an MICR toner comprised of styrene acrylates, styrene methacrylates, styrene butadienes, and the like, resin particles, and magnetite, such as MAPICO BLACK TM particles, enabling developers with a conductivity of from about $10^{-7}$ to about $10^{-11}$ ohm-cm.

In one embodiment of the present invnetion the process comprises an ionographic process which comprises the generation of a latent image comprised of characters in an ion printing magnetic image character recognition apparatus; thereafter developing the image with a developer wherein the toner is comprised of resin particles, pigment particles, and a Polywax; and subsequently providing the developed fused image with magnetic ink characters thereon to a reader/sorter device whereby toner offsetting and image smearing is minimized in said device, and wherein in an embodiment the amount of magnetite present is from about 20 to about 80 percent by weight.

The toner compositions selected for the process of the present invention are comprised of resin particles, magnetites, and Polywaxes with an average molecular weight of, for example, from about 1,000 to about 10,000, preferably 7,000, and more preferably 2,000. In one embodiment, there are selected for the MICR process of the present invention toner compositions comprised of resin particles, magnetite particles, and a POLYWAX 2000 TM component. Additionally, the toner compositions selected may include as additives, preferably external surface additives, in amounts, for example, of from about 0.1 to about 1.0 percent, and preferably 0.5 percent by weight of silica such as AEROSIL R972 TM, metal salts, metal salts of fatty acids such as zinc stearate, and the like, reference U.S. Pat. Nos. 3,720,617; 3,900,588 and 3,590,000, the disclosures of which are totally incorporated herein by reference.

Illustrated examples of suitable known toner resins selected for the toner and developer compositions and present in various effective amounts, providing the total amount of all components is equal to about 100 percent by weight, such as, for example, from about 40 percent by weight to about 80 percent by weight, include polyesters, polyamides, epoxy resins, polyurethanes, polyolefins, styrene acrylates, styrene butadienes, styrene methacrylates, vinyl resins, crosslinked styrene resins and polymeric esterification products of a dicarboxylic acid, and a diol comprising a diphenol. Various known suitable vinyl resins may be selected as the toner resin including homopolymers or copolymers of two or more vinyl monomers. Typical vinyl monomers that are subsequently polymerized include styrene, p-chlorostyrene, unsaturated mono-olefins such as ethylene, propylene, butylene, isobutylene, and the like; vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether. Examples of specific resins include styrene butadiene copolymers, especially styrene butadiene copolymers prepared by a suspension polymerization process, reference U.S. Pat. No.

4,558,108, the disclosure of which is totally incorporated herein by reference; and mixtures thereof.

As one toner resin there can be selected the esterification products of a dicarboxylic acid and a diol comprising a diphenol, which components are illustrated in U.S. Pat. No. 3,590,000, the disclosure of which is totally incorporated herein by reference. Other specific toner resins included styrene/methacrylate copolymers, styrene/acrylate copolymers, and styrene/butadiene copolymers, especially those as illustrated in the aforementioned patents; and styrene butadiene resins with high styrene content, that is exceeding from about 80 to 85 percent by weight of styrene, which resins are available as PLIOLITES TM from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol.

Examples of known magnetites selected for the toner and developer compositions utilized for the process of the present invention include those commercially available such as those illustrated in U.S. Pat. No. 4,517,268, the disclosure of which is totally incorporated herein by reference. Also, cubic magnetites such as MAPICO BLACK TM can be selected. The magnetites are generally present in the toner composition in an amount of from about 35 percent by weight to about 70 percent by weight, and preferably in an amount of from about 50 percent by weight to about 60 percent by weight. Alternatively, there can be selected mixtures of magnetites with pigment particles such as carbon black or equivalent pigments, which mixtures, for example, contain from about 35 percent to about 60 percent by weight of magnetite, and from about 0.5 percent to about 10 percent by weight of carbon black. Specifically, there may be selected hard, or acicular magnetites in amounts of from about 15 to about 40, and preferably from about 20 to about 30 percent by weight. Examples of hard magnetites include MO4232 TM and MO4431 TM available from Harcros Pigments Inc. The toner polymer is usually present in an amount of from about 30 to about 85 percent by weight.

Examples of crystalline waxes present in various effective amounts, such as for example from about 1 to about 10 weight percent, and usually dispersed in the toner resin particles are POLYWAX 2000 TM, POLYWAX 1000 TM, POLYWAX 3000 TM, available from Petrolite Corporation, and Hoechst PE130 TM, available from Hoechst-Celanese Corporation. These are of a weight average molecular weight, it is believed, of from about 1,000 to about 3,000 with POLYWAX 2000 TM being preferred.

Illustrative examples of optional charge enhancing additives present in the toner in various effective amounts such as, for example, from about 0.05 to about 10 percent by weight, and more preferably from about 0.5 to about 2 percent by weight, and enabling positively charged toner compositions with a triboelectric charge, for example, of from about 15 to about 40 microcoulombs per gram include alkyl pyridinium halides, such as cetyl pyridinium chlorides, reference U.S. Pat. No. 4,298,672, the disclosure of which is totally incorporated herein by reference; cetyl pyridinium tetrafluorobrates, quaternary ammonium sulfate, and sulfonate charge control agents, such as stearyl phenethyl dimethyl ammonium tosylates, as illustrated in U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like. Examples of charge enhancing additives present in various effective amounts, such as, for example, from about 0.05 to about 10 percent by weight, and preferably from about 1 to about 5 percent by weight, and more preferably from about 0.5 to about 2 weight percent that enable negatively charged toners with a triboelectric charge, for example, of from about −15 to about −40 microcoulombs per gram include Spilon TRH available from Hodagaya Chemical, ortho-halophenylcarboxylic acids, reference U.S. Pat. No. 4,411,974, the disclosure of which is totally incorporated herein by reference, potassium tetraphenyl borates, and the like.

Illustrative examples of carrier particles that can be selected for mixing with the toner compositions, thus permitting two component developers that can be selected for the process of the present invention, include those particles that are capable of triboelectrically obtaining a charge of opposite polarity to that of the toner particles. Accordingly, the carrier particles can be selected to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include steel, nickel, iron, ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 (abandoned) relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates and polymethacrylates; copolymers of vinyl chloride and trichlorofluoroethylene; and other known coatings. There can also be selected as carriers components comprised of a core with a double polymer coating thereover, reference U.S. Pat. Nos. 4,937,166, and 4,935,326, the disclosures of which are totally incorporated herein by reference. More specifically, there are illustrated in these patents carriers with a polymer mixture comprised of two polymers not in close proximity in the triboelectric series and a process for the preparation thereof with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary generally they are of a diameter of from about 50 microns to about 1,000 microns, thus allowing these particles to possess sufficient density to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner compositions illustrated herein can be prepared by a number of known methods, including mechanical blending and melt blending the toner resin particles, pigment particles or colorants, and Polywax, followed by mechanical attrition. Other methods include those well known in the art such as spray drying, mechanical dispersion, melt dispersion, dispersion polymerization, and suspension polymerization. More specifically, the toner compositions can be prepared by the simple mixing of polymeric resin, magnetite, and Polywax particles while heating, followed by cooling, micronization to enable toner size particles of, for example, an average diameter of from about 10 to about 25 microns, and subsequently classifying these particles for the primary purpose of removing fines, that is for example particles with a diameter of 5 microns or less, and very large coarse particles, that is with a diameter of greater than 30 microns. Also, the aforementioned toners can be prepared in a similar manner with an extrusion device wherein the product exiting from such a device is severed into pieces followed by micronization and classification.

With the process of the present invention, radiant, fusing, flash fusing, vapor fusing, and fusing with hard or soft rolls can be utilized. When hard roll fusing is selected, reference the 9700 TM MICR printer mentioned herein, the toner pile height is from about 5 to about 9 microns, and the image offsetting or image smearing advantages indicated are obtained with the toner and developer compositions illustrated, which advantages are not achieved with such compositions when the additives, such as the polymeric alcohols, are not present in the toner. Similar results are obtained with soft fuser rolls wherein the toner pile height is from about 9 to about 20 microns. With the aforesaid soft fuser rolls particularly, there results image smearing and offsetting in the reader/sorters when toners without the waxes illustrated herein are utilized. Accordingly, with the process of the present invention image smearing and image offsetting advantages are obtained as indicated herein, less sorter machine contamination is present, and other problems are minimized, especially when soft roll fusers are selected for fixing of the images, reference the Xerox Corporation 4040 TM.

The following examples are being submitted to further define various species of the present invention. These examples are intended to illustrate and not limit the scope of the present invention. Also, parts and percentages are by weight unless otherwise indicated. Comparative Examples and data are also presented.

EXAMPLE I

There was prepared by melt blending with heating in a Banbury, followed by mechanical attrition and classification a toner composition, average diameter of about 10 microns, comprised of 60.5 percent by weight of a styrene butadiene resin with 91 percent by weight of styrene and 9 percent by weight of butadiene, 32 percent by weight of the magnetite MO4232 TM, weight average molecular weight of 2,000, which toner had incorporated as an internal component 7.5 weight percent of POLYWAX 2000 TM available from Petrolite Corporation. Also included on the surface of the toner by blending was 0.3 percent by weight of AEROSIL R972 TM.

The aforementioned toner composition had a triboelectric charge thereon of a minus −15.5 microcoulombs per gram with the following carrier as determined by the known Faraday Cage apparatus.

Subsequently, there was prepared a developer composition by admixing the aforementioned formulated toner composition at a 4.5 percent toner concentration, that is 4.5 parts by weight of toner per 100 parts by weight of carrier, which carrier was comprised of an iron core, available from Hoeganaes Corporation, with a 0.4 weight percent of KYNAR ® coating which was applied in powder form.

The aforementioned developer composition was utilized to develop latent images generated in the Xerox Corporation 9700 TM MICR apparatus, commercially available, which images were fused with a hard roll fuser, resulting in personal checks with magnetic characters thereon. When these checks, about 5,000, were utilized in the IBM 3890 TM with a reader/sorter toner offsetting to the protective foils present on the read and write heads was minimized as evidenced by visual observation, and image smearing did not result on the final images as determined by visual observation. More specifically, 5,000 of the aforementioned created checks were passed through an IBM 3890 TM sorter 20 times, and the reject rate, that is where the magnetic image characters could not be read, was 0.1 percent or 5 beginning with the first pass and continuing up to the 20th pass, and image smearing was avoided. Thus, out of a total of 100,000 checks processed in the aforesaid reader/sorter only 5 were rejected. When repeating the aforementioned process with the exceptions that there was selected a toner and developer composition without the POLYWAX2000 TM, available from Petrolite Corporation, and 68 percent of resin, the protective foil on the read/write heads was contaminated with toner; it being noted that substantially no toner contamination (a layer of toner formed on the protective foil, which toner can transfer to another document and cause that document to be rejected; also from a visual perspective this toner layer is objectionable to a number of users) resulted on the aforesaid foils when the same toner and developer were utilized containing the POLYWAX 2000 TM, available from Petrolite. When the above process was repeated in the NCR 6780 TM, which contains no protective foils on the read and write heads, substantially no toner contamination was noted on the read and write heads with the toner and developer containing the POLYWAX 2000 TM as compared to toner contamination with the utilization of a toner containing no POLYWAX 2000 TM. It is believed that machine maintenance can be reduced when less toner contamination is present.

Also, similar toner and developer compositions of the present invention can be prepared and utilized for generating and utilizing checks with substantially similar desirable offsetting and image smearing results, and wherein the Polywax can be present in an amount of from about 2 to about 15, and preferably from about 4 to about 6.9 percent by weight.

Further, there were prepared similar toner and developer compositions with the exceptions that there was selected in place of the POLYWAX 2000 TM, POLYWAX 3000 TM, available from Petrolite Chemical. When checks formed with the aforementioned developer compositions were utilized in the IBM 3890 TM as illustrated above the reject rate was less than 0.08 percent. Toner offsetting to the read and write heads was avoided as evidenced by visual observation, and image smearing did not result as determined by visual observation.

EXAMPLE II

A positively charged toner composition with a triboelectric charge thereon of 18 microcoulombs per gram was prepared by repeating the procedure of Example I with the exception that 6 weight percent of POLYWAX 2000 TM and 62 percent of resin was selected.

Personal checks were then generated in the Xerox 4040 TM, wherein fixing of the developed images was accomplished with a soft silicone roll, and these checks were subsequently utilized (sorted) in the IBM 3890 TM by repeating the procedure of Example I, and substantially similar results were obtained, that is toner offsetting (contamination) to the read and write heads was substantially avoided as evidenced by visual observation, and image smearing did not result on the final images as determined by visual observation for 100,000 checks. The reject rate was 0.32 percent, that is 0.32 percent of the documents were rejected by the reader/-sorter.

When the above process was repeated, and there was selected a positively charged toner composition containing 0 percent by weight of the Polywax component and 68 percent by weight of the styrene butadiene resin, significant undersirable accumulation of toner on the read and write heads foils resulted and the reject rate, which was unacceptable, was 1.5 percent.

EXAMPLE III

Toner and developer were prepared by repeating the procedure of Example II, and thereafter the personal checks generated were utilized in the NCR 6780 TM. Substantially similar results were obtained, that is the reject rate was 0.2 percent as compared to an average reject rate of 1 percent with the same toner containing no Polywax and 68 percent resin.

With the present invention in embodiments there may also be provided a developer with extended life conductivity, and wherein the developer conductivity can be increased without adversely effecting substantially the toner triboelectric characteristics by utilizing a toner with a Polywax, such as POLYWAX 2000 TM. With 6 percent of POLYWAX 2000 TM a developer such as that of Example II possessed a conductivity of about $10^{-11}$ ohm at 4 percent toner concentration; with 3 percent of POLYWAX 2000 TM the conductivity at 4 and 1 percent toner concentration was about $10^{-12}$ and about $10^{-9}$ ohm-cm, respectively. Developer containing toner with 6 percent of POLYWAX 2000 TM can extend the developer life significantly, and maintain the conductivity, thus enabling use of such developers for MICR processes with many of the advantages illustrated herein. Also, there can be an increase in packed toner density as the Polywax level in the toner increases from about 2 to about 6 weight percent.

Other modifications of the present invention may occur to those skilled in the art subsequent to a review of the present application. The aforementioned modifications, including equivalents thereof, are intended to be included within the scope of the present invention.

What is claimed is:

1. An ionographic process consisting essentially of the generation of a latent image comprised of characters; developing the image with a developer with a conductivity of from between about $10^{-8}$ to about $10^{-12}$ ohm-cm$^{-1}$ consisting essentially of a toner comprised of resin particles, magnetite particles, and a crystalline high density wax with a weight average molecular weight of from about 1,000 to about 10,000 and coated carrier particles; and subsequently providing the developed image with magnetic ink characters thereon to a reader/sorter device, and wherein the conductivity of the developer increases as the amount of wax added to the toner increases.

2. A process in accordance with claim 1 wherein the crystalline high density wax is present in an amount of about 2 to about 6 weight percent.

3. A process in accordance with claim 1 wherein the resin particles are comprised of styrene acrylates, styrene methacrylates, or styrene butadiene copolymers.

4. A process in accordance with claim 1 wherein the magnetite is acicular or spherical.

5. A process in accordance with claim 1 wherein the toner composition contains magnetite particles in an amount of from about 30 to about 70 percent by weight.

6. A process in accordance with claim 1 wherein the toner contains a charge enhancing additive.

7. A process in accordance with claim 1 wherein the resin particles are comprised of a styrene butadiene copolymer which contains about 91 percent by weight of styrene, and about 9 percent by weight of butadiene.

8. A process in accordance with claim 1 wherein the developed image with magnetic ink characters thereon is provided to a reader/sorter device, wherein image smearing is avoided or minimized.

9. A magnetic image character imaging process consisting essentially of the generation of a latent image comprised of characters; developing the characters with a developer with a conductivity of from between about $10^{-8}$ to about $10^{-12}$ ohm-cm$^{-1}$ consisting essentially of a toner comprised of resin particles, magnetite particles, and a Polywax with a weight average molecular weight of from about 1,000 to about 7,000 and coated carrier particles, and wherein the conductivity of the developer increases as the amount of wax added to the toner increases.

10. A process in accordance with claim 9 wherein the Polywax is present in an amount of from about 2 to about 6 weight percent.

11. A process in accordance with claim 9 wherein the Polywax has a density of from about 0.95 to about 0.98.

12. A process in accordance with claim 9 wherein the wax has a molecular weight of 1,000 weight average and a density of from about 0.95 to about 0.98.

13. A process in accordance with claim 9 wherein the resin particles are comprised of styrene acrylates, styrene methacrylates, or styrene butadienes.

14. A process in accordance with claim 9 wherein the magnetite is acicular or spherical.

15. A process in accordance with claim 9 wherein the toner composition contains magnetite particles in an amount of from about 30 to about 70 percent by weight.

16. A process in accordance with claim 9 wherein the toner contains a charge enhancing additive.

17. A process in accordance with claim 16 wherein the charge enhancing additive is selected from the group consisting of distearyl dimethyl ammonium methylsulfate, cetyl pyridinium halides, and stearyl phenethyl dimethyl ammonium tosylates.

18. A process in accordance with claim 16 wherein the charge enhancing additive is potassium tetraphenyl borate.

19. A process in accordance with claim 9 wherein the magnetite is acicular and is present in an amount of from about 15 to about 40 percent by weight.

20. A process in accordance with claim 9 wherein the magnetite is cubic and is present in an amount of from about 50 to about 60 percent by weight.

21. A process in accordance with claim 9 wherein the toner surface is treated with from 0.1 to 0.7 percent of hydrophobic silica particles.

22. A process in accordance with claim 9 wherein the coated carrier particles are comprised of a steel or a ferrite core with a coating thereover selected from the group consisting of polychlorotrifluoroethylene-co-vinylchloride copolymer, a polyvinylidene fluoropolymer, a terpolymer of styrene, methacrylate, and an organo silane, fluorinated ethylene-propylene copolymers, and polytetrafluoroethylene.

23. A process in accordance with claim 22 wherein the carrier particles are coated with polymethylmethacrylate and carbon black.

24. A process in accordance with claim 22 wherein the carrier particles have a stable conductivity of from about $10^{-6}$ to about $10^{-12}$ ohm-cm.

25. A process in accordance with claim 9 wherein the amount of wax added is increased from about 2 to about 6 weight percent.

26. A process in accordance with claim 25 wherein the coating for the carrier is comprised of polyvinylidene fluoride.

* * * * *